US005777271A

United States Patent [19]

Carlson et al.

[11] Patent Number: 5,777,271

[45] Date of Patent: Jul. 7, 1998

[54] CABLE HAVING AN AT LEAST PARTIALLY OXIDIZED ARMOR LAYER

[75] Inventors: Bruce Carlson, Hickory; David C. Esker, Conover; Jana Horska, Hickory, all of N.C.

[73] Assignee: CommScope, Inc., Catawba, N.C.

[21] Appl. No.: 588,560

[22] Filed: Jan. 18, 1996

[51] Int. Cl.[6] ..... H01B 7/18

[52] U.S. Cl. ..... 174/107; 174/109

[58] Field of Search ..... 174/102 R, 35 R, 174/107, 109

[56] References Cited

U.S. PATENT DOCUMENTS

| | | | |
|---|---|---|---|
| 3,087,007 | 4/1963 | Jachimowicz | 174/110 R |
| 3,551,586 | 12/1970 | Dembiak | 174/107 |
| 3,651,244 | 3/1972 | Silver et al. | 174/36 |
| 3,855,847 | 12/1974 | Leschek | 73/587 |
| 4,075,419 | 2/1978 | Virkus | 174/107 |
| 4,100,003 | 7/1978 | Trusch | 156/54 |
| 4,130,450 | 12/1978 | Bahder et al. | 156/48 |
| 4,541,686 | 9/1985 | Barfuss et al. | 385/107 |
| 4,729,629 | 3/1988 | Saito et al. | 385/101 |
| 5,043,539 | 8/1991 | Connole et al. | 174/107 |
| 5,281,757 | 1/1994 | Marin et al. | 174/23 R |
| 5,378,300 | 1/1995 | Huvard et al. | 156/344 |

FOREIGN PATENT DOCUMENTS 2114556 3/1985 United Kingdom .

*Primary Examiner*—Bot L. Ledynh
*Assistant Examiner*—Marc D. Machtinger
*Attorney, Agent, or Firm*—Bell Seltzer Intellectual Property Group of Alston & Bird LLP

[57] ABSTRACT

A coaxial, fiber optic, or twisted pair cable having a is core surrounded by an armor layer and an outer protective jacket such that relative movement between the armor layer and the protective jacket is permitted. The armor layer has a pair of opposing longitudinal edge portions and is wrapped around a cable core such that a longitudinally extending seam is produced. The outer surface of the armor layer has an adhesive layer disposed thereon for bonding an outer protective jacket thereto. Portions of the outer surface of the armor layer adjacent the longitudinally extending seam are oxidized, thereby effectively neutralizing the adhesive layer. The oxidized portions of the armor layer reduce, if not eliminate, adherence between the protective jacket and the armor layer along the longitudinally extending seam.

12 Claims, 3 Drawing Sheets

CABLE HAVING AN AT LEAST PARTIALLY OXIDIZED ARMOR LAYER

FIELD OF THE INVENTION

This invention relates generally to coaxial and fiber optic cables and associated fabrication methods and, more particularly, to coaxial and fiber optic cables having armor layers surrounding a core and associated fabrication methods.

BACKGROUND OF THE INVENTION

Coaxial cables generally include a core consisting of a center conductor, typically formed of copper clad steel, copper clad aluminum, or solid copper, a dielectric material surrounding the center conductor, an outer conductor surrounding the dielectric material, and a protective jacket surrounding the dielectric material. A fiber optic cable typically includes a core, typically formed of at least one buffer tube having optical fibers disposed therewithin and one or more strength members. In certain applications, it is desirable to surround these coaxial and fiber optic cable "cores" with additional protective layers.

These fiber optic and coaxial cable cores are often protected by an armor layer surrounding the core, and a protective jacket surrounding the armor layer. The armor layer is typically formed of a metallic tape which is folded about the cable core during assembly of the cable such that the lateral edge portions of the armor layer overlap to form a longitudinally extending overlap region. Typically, the outer surface of the metallic tape, which is formed into the armor layer, is coated with an adhesive, such that the armor layer effectively bonds to the inside surface of the protective jacket following assembly. Typically, this adhesive is a thermoplastic film, for example a random copolymer of ethylene and acrylic acid (EAA). This bonding between the armor and the protective jacket ensures the integrity of the resulting fiber optic and coaxial cable. In addition, the adhesive is beneficial in protecting the armor layer from corrosion.

Unfortunately, due at least in part to the integral bonding of the cable, twisting of cables with such an armor layer can cause the overlapping edge portions of the armor layer to cut into the protective jacket, thereby weakening the protective jacket. In extreme cases, the edge may cause "zippering" of the protective jacket, wherein the protective jacket is split open to expose the armor layer and cable core to harmful environments.

A number of efforts have been made to reduce the potential for damage caused by the overlapping edges of an armor layer. Most of these efforts have focused on providing relative motion between the armor layer and the protective jacket as the cable is twisted. For example, U.S. Pat. No. 4,729,629 to Saito et al. describes a cable having a jelly-like lubricant material positioned between the armor layer and the protective jacket to provide for relative motion. U.S. Pat. No. 4,130,450 to Bahder describes covering the overlapped seam of an armor layer with bridging tape to prevent the outer edge of the overlapped seam from indenting into the overlying protective jacket.

Unfortunately, both the application of lubricant to the armor layer and the addition of a layer of tape complicates the cable manufacturing process, thereby increasing the time for, and cost of, production. In addition, a cable having a lubricant therein can be somewhat messy when being installed or repaired by a technician in the field.

SUMMARY OF THE INVENTION

It is therefore an object of the present invention to provide an elongate cable having an outer protective jacket that is resistant to damage from an underlying armor layer having overlapping longitudinal edge portions.

It is another object of the present invention to provide an elongate cable that is readily manufacturable and which permits relative movement between portions of an outer protective jacket and portions of an underlying armor layer.

It is another object of the present invention to provide an elongate cable that is readily manufacturable and which permits relative movement between portions of an outer protective jacket and portions of an underlying armor layer.

These and other objects are provided according to one aspect of the present invention, by an elongate cable comprising a cable core surrounded by an armor layer having a portion of its surface oxidized, and a protective jacket surrounding the armor layer. The cable core may be a fiber optic cable core, a coaxial cable core, a twisted pair, or the core of any other type of cable desired. The armor layer, which surrounds and is adjacent to the cable core, has inner and outer surfaces, which are typically corrugated, and comprises a pair of opposing longitudinal edge portions overlapped to define a longitudinally extending seam. The armor layer surrounds the cable core such that the inner surface faces the cable core. The armor layer may be formed from metallic material.

The protective jacket surrounds the armor layer and is secured thereto by an adhesive layer disposed between the armor layer and the protective jacket. The surface of the armor layer is oxidized along the longitudinally extending seam to thereby reduce adherence between the protective jacket and the armor layer and to allow relative movement therebetween. The oxidation may extend around as much of the circumference of the armor layer as desirable. Typically, the oxidation extends in equal opposing circumferential directions from the longitudinally extending seam and covers between about twenty percent (20%) and about thirty percent (30%) of the circumference of the armor layer. However, substantially the entire circumference of the armor layer may be oxidized, if so desired.

According to another aspect of the present invention, a method of producing an elongate cable, wherein relative movement between an armor layer having opposing longitudinal edge portions and a protective jacket is permitted, is provided. According to the invention, an elongate fiber optic or coaxial cable core is advanced along a path of travel. An armor layer having an adhesive thereon is then wrapped around the advancing cable core such that the opposing longitudinal edge portions of the armor layer overlap to define a lengthwise extending seam. A portion of the outer surface of the armor layer having an adhesive layer disposed thereon is then oxidized. A protective jacket is extruded around and adjacent the outer surface of the armor layer, such that the oxidized portion of the armor layer does not adhere to the protective jacket.

According to the present invention, oxidizing an armor layer generally comprises heating portions of the armor layer having an adhesive layer disposed thereon in the presence of oxygen. Acceptable oxide generators include means for heating an armor layer in the presence of oxygen utilizing a flame, a plasma, microwave energy, or the like.

By oxidizing at least a portion of the armor layer, adherence of the armor layer to the protective jacket along the longitudinally extending seam of the armor layer is reduced, if not eliminated. Accordingly, the longitudinal edges of the armor layer can move relative to one another as the cable is twisted during or following installation. As a result of this relative motion, the longitudinal edges of the armor layer will not cut into the protective jacket as much as in conventional cables, if at all. Therefore, the cable core will not be exposed to environmental hazards and the cable of the present invention will have a longer effective lifetime.

DETAILED DESCRIPTION OF PREFERRED EMBODIMENTS

Figure 1:
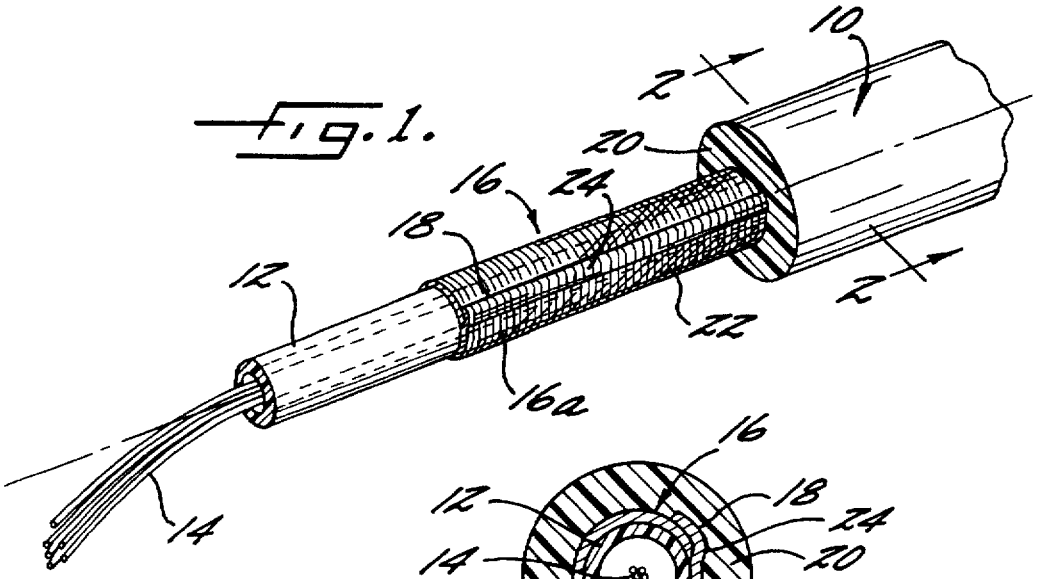
FIG. 1 is a perspective view of a fiber optic cable, according to one embodiment of the present invention, with portions of the cable removed for clarity of illustration.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout.

Figure 2:
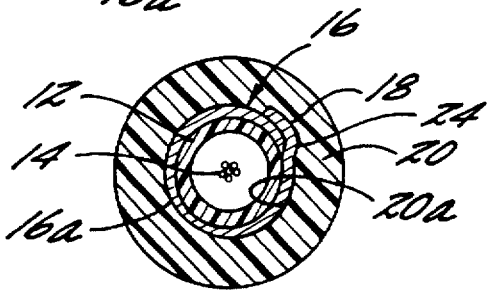
FIG. 2 is a greatly enlarged cross-sectional view of the fiber optic cable illustrated in FIG. 1 taken along lines 2—2.

Referring first to FIGS. 1–2, a fiber optic cable 10, incorporating the present invention, is illustrated. The cable 10 includes an elongate buffer tube 12, typically formed of extruded plastic. A plurality of optical fibers 14 are positioned within the buffer tube 12. The buffer tube 12 typically has a predetermined inner cross-sectional area larger than the combined cross-sectional areas of the optical fibers 14 so that the optical fibers are carried in a loose-buffered relationship within the buffer tube 12, as would be readily understood by those skilled in the art. Although not illustrated, the buffer tube may be wrapped with one or more layers of material or tape, and filled with water-repellant material to define a cable core for the fiber optic cable 10.

Surrounding the core of the fiber optic cable 10 including the buffer tube 12, in the illustrated embodiment, is an armor layer 16 having an overlapping edge portion 18 extending longitudinally along the cable 10. The primary purpose of the armor layer 16 is to protect the cable 10 from rodents which may bite the cable, and from corrosive or otherwise destructive environments. The armor layer 16 may be formed of metal, plastic, or any other suitably tough material. Typically, the armor layer 16 is corrugated so as to allow the fiber optic cable 10 to flex during its installation.

The armor layer 16 is typically a metallic tape and is wrapped around the buffer tube, producing a layer having an overlapping longitudinal edge portion 18. Surrounding the armor layer 16 is a protective outer jacket 20, typically formed of a thermoplastic polymer material, such as polyethylene. A thin adhesive layer 22 coats the outer surface **16*a* of the armor layer 16 so that the inner surface 20*a* of the outer plastic jacket 20** bonds to the armor layer. Typically, the adhesive used is a random copolymer of ethylene and acrylic acid (EAA).

According to the present invention, the overlapping edge portion 18 of the armor layer 16, and portions adjacent thereto, are subjected to an oxide generator, such as a heat source, to oxidize a portion of the adhesive 22. The oxidation 24 effectively neutralizes the underlying adhesive layer 22 and prevents the armor layer 16 from bonding to the inner surface **20*a* of the plastic jacket 20. Accordingly, the overlapping edge portion 18 of the armor layer 16 and the outer jacket 20 are unbonded and can move relative to each other, thereby reducing the likelihood of the overlapping edge portion causing damage to the plastic jacket. Oxidation may be selectively generated along the armor layer 16. Accordingly, as much of the outer surface 16*a* of the armor layer 16 may be oxidized as desired. It is preferable that between about twenty percent and thirty percent of the outer surface 16*a* of the armor layer 16 is oxidized. However, it may be desirable to oxidize the entire outer surface 16*a* of the armor layer 16 in order to facilitate the removal of the outer protective jacket 20** during cable installation and maintenance.

Figure 3:
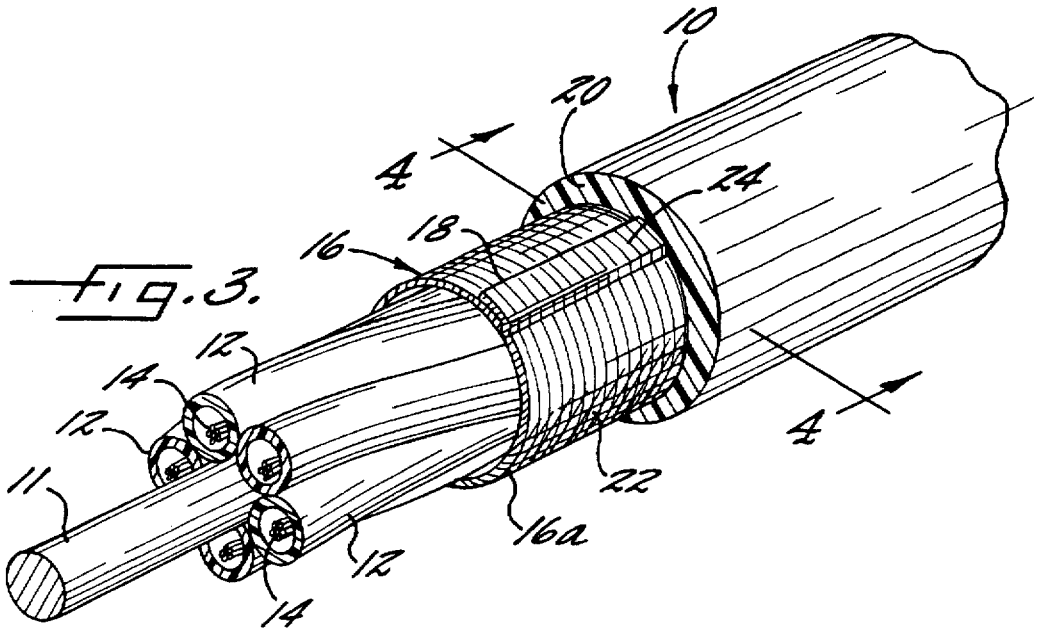
FIG. 3 is a perspective view of a fiber optic cable having a plurality of buffer tubes, according to another embodiment of the present invention, with portions of the cable removed for clarity of illustration.
Figure 4:
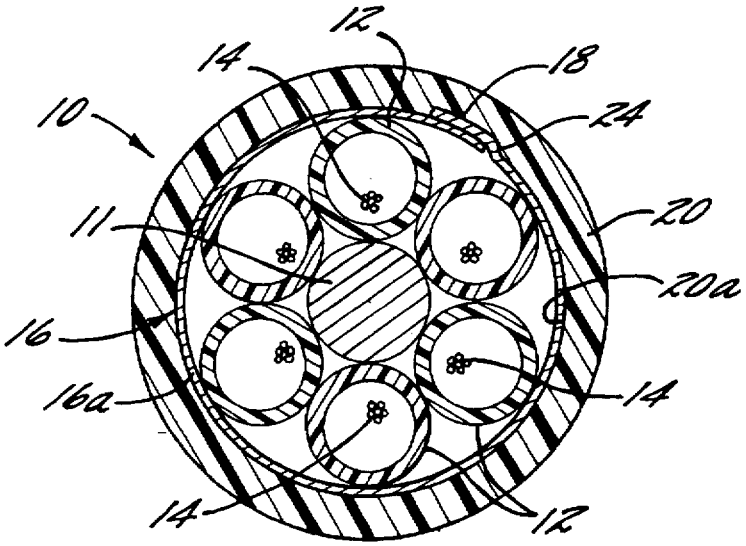
FIG. 4 is a greatly enlarged cross-sectional view of the fiber optic cable illustrated in FIG. 3 taken along lines 4—4.

Referring now to FIGS. 3–4, another embodiment of a fiber optic cable is shown which includes a fiber optic core comprised of a plurality of buffer tubes 12 stranded about a central strength member 11. Often, a layer of protective material (not shown), such as Kevlar®, is wrapped around the plurality of buffer tubes 12. This layer of material provides increased strength to the cable and further protects the underlying buffer tubes 12. Surrounding the cable core of this embodiment is an armor layer 16 having an overlapping edge portion 18 extending longitudinally along the cable 10. Surrounding the armor layer 16 is a protective outer jacket 20. A thin adhesive layer 22 coats the outer surface **16*a* of the armor layer 16 so that the inner surface 20*a* of the outer plastic jacket 20 bonds to the armor layer. According to the present invention, at least a portion of the adhesive layer 22 adjacent the overlapping edge portion 18** is oxidized, as described above, to prevent bonding to the outer protective jacket along the overlapping edge portion.

Figure 5:
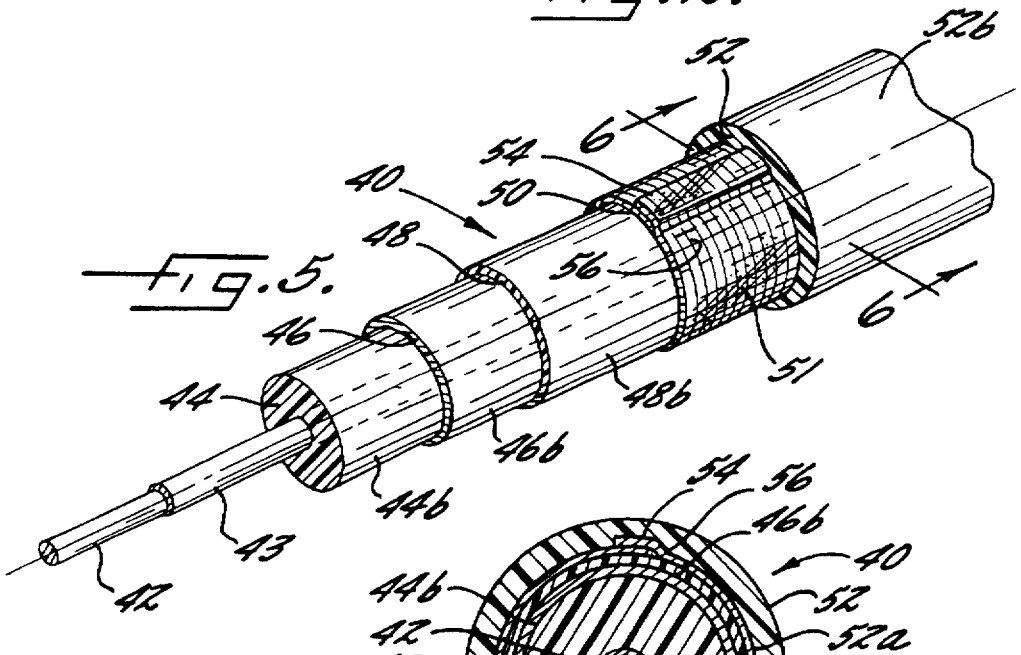
FIG. 5 is a perspective view of a coaxial cable, according to one embodiment of the present invention, with portions of the cable removed for clarity of illustration.
Figure 6:
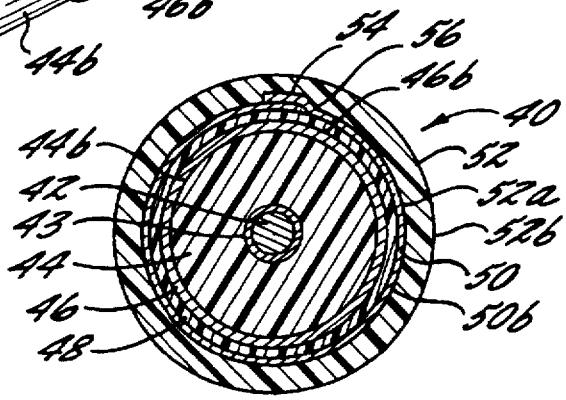
FIG. 6 is a greatly enlarged cross-sectional view of the coaxial cable illustrated in FIG. 5 taken along lines 6—6.

Referring now to FIGS. 5–6, a coaxial cable 40 incorporating the present invention is illustrated. A coaxial cable 40 typically has a cable core which includes an elongate center conductor 42, cladding 43 surrounding the center conductor, dielectric material 44, such as a foamed polymer dielectric, surrounding the cladded center conductor, an outer conductor 46, and a first protective jacket 48. When protection of a coaxial cable against harsh environments is required, an armor layer 50 is often wrapped around the first protective jacket 48, followed by the extrusion of a second protective jacket 52 around the armor layer. The armor layer 50 provides protection for the cable 40, such as from rodents which may bite the cable, and from corrosive or otherwise destructive environments. The armor layer 50 may be formed of metal, plastic, or any other suitably tough material. Typically, the armor layer 50 is corrugated so as to allow the fiber optic cable 40 to flex during its installation.

The armor layer 50 is typically applied to the first protective jacket 48 as a metallic tape and then wrapped around the first protective jacket, producing a layer having an overlapping longitudinal edge portion 54 along the cable. Surrounding the armor layer 50 is a second protective jacket 52, typically formed of a thermoplastic polymer material, such as polyethylene. A thin adhesive layer 51 coats the outer surface 50*b* of the armor layer 50 so that the inner surface 52*a* of the second protective plastic jacket 52 bonds to the armor layer. Typically, the adhesive used is a random copolymer of ethylene and acrylic acid (EAA).

In the illustrated embodiment, only a single inner conductor 42 with cladding 43 is shown, as this is the arrangement most commonly used for coaxial cables of the type used for transmitting RF signals, such as television signals. However, the present invention is applicable to coaxial cables having more than one inner conductor.

According to the present invention, the overlapping edge portion 54, of the armor layer 50, and portions adjacent thereto, are subjected to an oxide generator, such as a heat source, to oxidize a portion of the adhesive 51. The oxidation 56 effectively neutralizes the underlying adhesive layer 51 and prevents the armor layer 50 from bonding to the inner surface 52*a* of the second protective jacket 52. Accordingly, the overlapping edge portion 54 of the armor layer 50 and the second protective jacket 52 are unbonded and can move relative to each other, thereby reducing the likelihood of the overlapping edge portion causing damage to the plastic jacket. Oxidation may be selectively generated along the armor layer 50. Accordingly, as much of the outer surface 50*b* of the armor layer 50 may be oxidized as desired. It is preferable that between about twenty percent and thirty percent of the outer surface 50*b* of the armor layer 50 is oxidized. However, it may be desirable to oxidize the entire outer surface 50b*b* of the armor layer 50 in order to facilitate the removal of the second protective plastic jacket 52 during cable installation and maintenance.

The present invention may be incorporated in trunk and distribution (T&D) fiber optic and coaxial cables, which are adapted to span relatively long lengths. The present invention may also be incorporated in fiber optic and coaxial drop cables which typically extend between a cable tap, at which point the drop cable is connected to a T&D cable, and a customer of the particular transmission system. The present invention may also be incorporated in twisted-pair cables and other cables employing an armor layer having an overlapping edge portion which is surrounded by a protective jacket.

Figure 7:
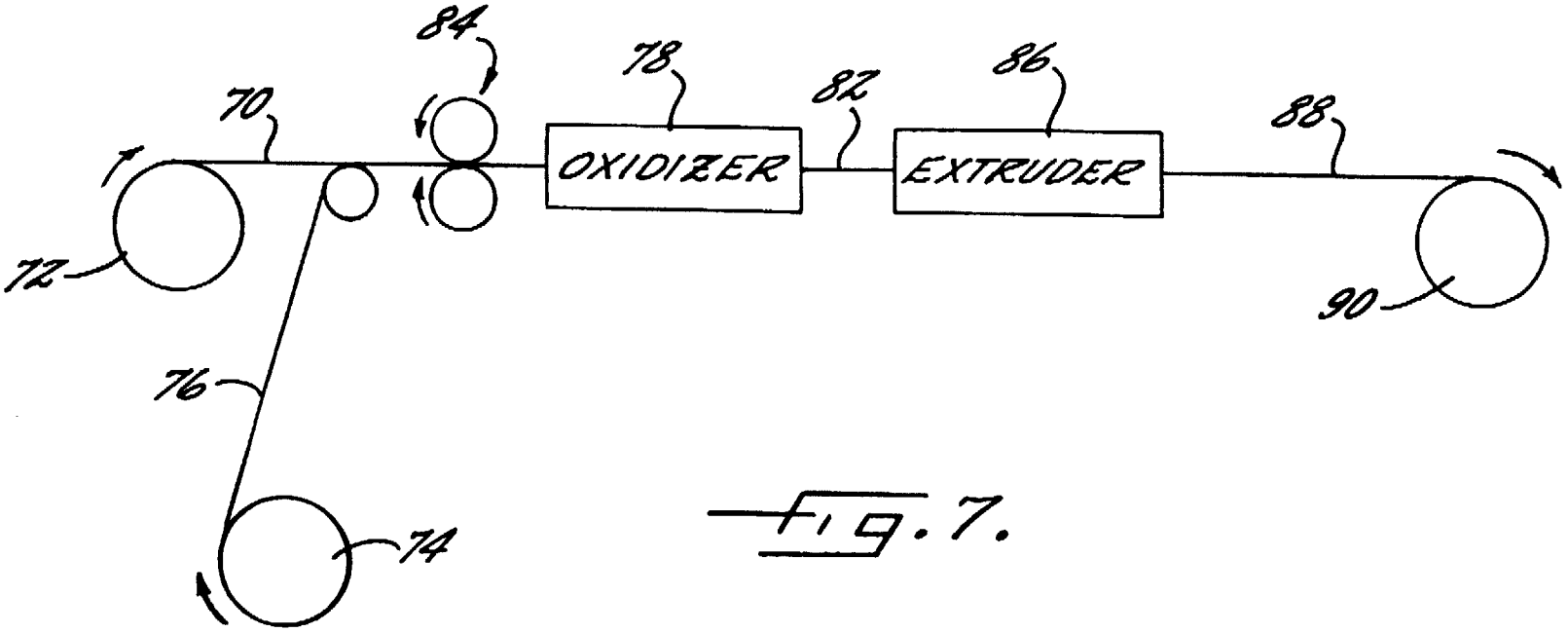
FIG. 7 is a schematic diagram of a method of making an elongate cable, according to the present invention.

Referring now to FIG. 7, a method and apparatus for making a cable, according to the present invention, is schematically illustrated. A premanufactured cable core 70 is supplied from a suitable supply reel 72. The cable core 70 may be a coaxial cable core, a fiber optic cable core, a twisted pair core, or the core of any other type of cable desired. An armor layer 76, having a layer of adhesive on its outer surface, is supplied from a suitable reel 74. The adhesive layer is typically applied by the manufacturer of the armor layer, and typically covers the entire outer surface of the layer. However, adhesive can be applied to the armor layer upstream from the supply reel 74. The armor layer 76 is wrapped around the advancing cable core 70 via forming rollers 84 and then supplied to an oxidizer 78. As known to those having skill in the art, the armor layer may be corrugated (not shown) prior to being wrapped around the advancing cable core 70.

In the oxidizer 78, the longitudinally extending edge portions of the armor layer 76, having an adhesive thereon, are oxidized, such as by exposing them to heat in the presence of oxygen. However, any portion of the outer surface of the armor layer 76 may be oxidized. Typically between about twenty percent (20%) and thirty percent (30%) of the outer surface of the armor layer adjacent each longitudinally extending edge portion is oxidized. Preferably, the oxidation extends equally from each longitudinally extending edge portion. In some cases, it may be desirable to oxidize the entire outer surface of a portion of the armor layer 76 to facilitate the removal of the protective jacket from the armor layer during cable installation or maintenance.

Preferably, a flame is used to oxidize the adhesive. By regulating the position and strength of the flame, the width of the oxidized portion of the armor layer can be controllably adjusted, thereby controlling the size of the resulting unbonded region between the armor layer and the protective jacket. Preferable flame sources include propane and oxygen. As would be understood by those having skill in the art, oxidation may be produced along the longitudinally extending edge portions of the armor layer 76 by a variety of heat sources in the presence of oxygen. In one embodiment, the armor layer may be exposed to a plasma-induced reactive oxygen atmosphere. In another embodiment, microwave energy may be utilized to create an oxide layer.

Because the oxidation effectively neutralizes the adhesive, the armor layer and the protective jacket of the cable bond, except where oxidation is present. The wrapped cable core 82 is then advanced through an extruder 86. As is known to those skilled in the art, an extruder 86 forms the plastic protective jacket about the wrapped cable core 82. As would be understood by those having skill in the art, additional components, such as strength members and ripcords may be added prior to the extrusion of the protective jacket. Additionally, the protective jacket may also include tracers and other marking indicia, added during or after the extrusion step.

The cable 88 having an extruded protective jacket is thereafter cooled with conventional cooling means (not shown), such as one or more water troughs, as known to those skilled in the art, to thereby fully solidify the extruded jacket. The thus-formed cable 88 may be wound upon a take-up reel 90 for shipping and installation.

By oxidizing at least a portion of the armor layer, adherence of the armor layer to the protective jacket along the longitudinally extending seam of the armor layer is reduced, if not eliminated. Accordingly, the longitudinal edges of the armor layer can move relative to one another as the cable is twisted during or following installation. As a result of this relative motion, the longitudinal edges of the armor layer will not cut into the protective jacket as much as in conventional cables, if at all. Therefore, the cable core will not be exposed to environmental hazards and the cable of the present invention will have a longer effective lifetime.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An elongate cable comprising:

an elongate cable core;

an armor layer surrounding and adjacent said cable core, said armor layer comprising:

a pair of opposing longitudinal edge portions overlapping to define a longitudinally extending seam; and inner and outer surfaces, said inner surface facing said cable core;

a protective jacket surrounding said armor layer;

an adhesive layer disposed between said armor layer and said protective jacket for securing said protective jacket to said armor layer; and oxidation disposed on said armor layer along said longitudinally extending seam to thereby reduce adherence between said protective jacket and said armor layer along said longitudinally extending seam and to allow relative movement therebetween.

2. An elongate cable according to claim 1, wherein said cable core is a fiber optic cable core or a coaxial cable core.

3. An elongate cable according to claim 1, wherein said armor layer is metallic.

4. An elongate cable according to claim 1, wherein said oxidation extends around said armor layer in opposing circumferential directions from said longitudinally extending seam.

5. An elongate cable according to claim 4, wherein said opposing circumferential directions are substantially equal.

6. An elongate cable according to claim 4, wherein said oxidation extends around said armor layer between about twenty percent and about thirty percent of the circumference of said armor layer.

7. An elongate cable according to claim 1, wherein said oxidation extends around substantially the entire circumference of said armor layer.

8. An elongate cable comprising:

an elongate cable core;

an armor layer surrounding and adjacent said cable core, said armor layer comprising inner and outer surfaces, said inner surface facing said cable core;

a protective jacket surrounding said armor layer;

an adhesive layer disposed between said armor layer and said protective jacket for securing said protective jacket to said armor layer; and oxidation disposed on said armor layer to thereby reduce adherence between said protective jacket and the oxidized portion of said armor layer.

9. An elongate cable according to claim 8, wherein said cable core is a fiber optic cable core or a coaxial cable core.

10. An elongate cable according to claim 8, wherein said armor layer is metallic.

11. An elongate cable according to claim 8, wherein said oxidation extends around said armor layer between about twenty percent and about thirty percent of the circumference of said armor layer.

12. An elongate cable according to claim 8, wherein said oxidation extends around substantially the entire circumference of said armor layer.

* * * * *